US005697500A

United States Patent [19]

Walker

[11] Patent Number: 5,697,500

[45] Date of Patent: Dec. 16, 1997

[54] INSULATED STORAGE/TRANSPORT CONTAINER FOR PERISHABLES

[76] Inventor: David Miller Hugh Walker, 10 Farrer St., Braddon Act, Australia

[21] Appl. No.: 663,178

[22] PCT Filed: Dec. 11, 1995

[86] PCT No.: PCT/AU95/00832

§ 371 Date: Jun. 17, 1996

§ 102(e) Date: Jun. 17, 1996

[87] PCT Pub. No.: WO96/18557

PCT Pub. Date: Jun. 20, 1996

[30] Foreign Application Priority Data

Dec. 12, 1994 [AU] Australia ..... PM 9979

[51] Int. Cl.[6] ..... B65D 21/032

[52] U.S. Cl. ..... 206/509; 206/507; 206/511; 220/4.27

[58] Field of Search ..... 220/4.27, 4.26, 220/23.6; 206/509, 508, 507, 821, 511

[56] References Cited

U.S. PATENT DOCUMENTS

| | | | |
|---|---|---|---|
| 4,619,366 | 10/1986 | Kreeger | 206/507 |
| 4,936,458 | 6/1990 | Tabler et al. | 206/507 |
| 4,960,207 | 10/1990 | Tabler et al. | 206/507 |
| 5,325,966 | 7/1994 | Chang | 206/509 |
| 5,332,114 | 7/1994 | Sano et al. | 220/4.27 |
| 5,544,751 | 8/1996 | Klodt et al. | 220/4.27 |

FOREIGN PATENT DOCUMENTS

| | | | |
|---|---|---|---|
| 12956/70 | 8/1973 | Australia . | |
| B82484/87 | 12/1988 | Australia . | |
| 0518826A2 | 12/1992 | European Pat. Off. . | |
| 2618757 | 2/1989 | France . | |
| 2631610 | 11/1989 | France . | |
| 4244713 | 12/1993 | Germany | 220/4.27 |
| 2265706 | 6/1993 | United Kingdom . | |

*Primary Examiner*—Stephen J. Castellano
*Attorney, Agent, or Firm*—Duane, Morris & Heckscher LLP

[57] ABSTRACT

A closable, stackable packing container made of insulating material for the storage of perishables and transport thereof without the need for refrigeration in transit comprises a tray (1) and a lid (2) to tightly close the container. Projections (9) on the wall and correspondingly shaped and positioned recesses (10) in the tray and in the lid are asymmetrically arranged. The container may be used in a transit mode wherein projections (9) fit within and mate with corresponding recesses (10) in lid (2) so that the container is substantially airtight. Or, the container may be used in a storage mode wherein lid (2) rests on top of projections (9) and is then spaced from the rim to allow circulating refrigerating air to flow into the tray and around the contents to cool them. A plurality of containers may be stacked in either mode.

11 Claims, 2 Drawing Sheets

INSULATED STORAGE/TRANSPORT CONTAINER FOR PERISHABLES

FIELD OF INVENTION

The invention relates to a packing container and, more particularly, to a packing container for the storage and transport of perishables such as fruit, vegetables, meat, seafood and other products which require protection from deterioration. Transportation by road, by sea and/or by air of perishable products over long distances, not only within a country but also between countries and continents, is an expanding development of modem commerce. It is common to transport perishables in refrigerated compartments but that requires specially equipped vehicles and is costly. It would be more cost effective if perishables could be transported over long distances without the need for refrigeration in transit.

DESCRIPTION OF THE PRIOR ART

Packing containers have been made in a variety of shapes and sizes which of course are dictated principally by the size and nature of the intended contents. One commonly used container is a packing case comprising a tray with a substantially rectangular floor and upstanding side and end walls extending substantially at right angles to the floor. Sometimes, containers of that type have been provided with a lid. For convenience, this invention will be described in relation to a packing container of that shape. However, it must be emphasised that the invention is applicable to containers of other shapes. The size of the base of a packing container for storage and transport has usually been designed so that containers fit on a standard pallet used for materials handling purposes with little waste of pallet space. The economics of transportation and materials handling is very much dependant on efficient use of pallet space. The wall height of trays has usually ranged from a shallow tray to a deep container to suit the intended contents.

The usual methods of storage, handling and transportation of laden packing containers indicate that the containers should be made of strong material, particularly when the laden packing containers are stacked one upon another and where the contents such as fruit must be protected against damage. Furthermore, the materials need to be lightweight in relation to the contents to allow economic transportation over long distances, particularly by air. Packing containers should also be made of waterproof material and thus resistant to high humidities. To this end, it has now become commonplace to make packing containers from expanded foam synthetic plastics such as polystyrene.

In order to improve the stability of a stack of packing containers made from expanded foam synthetic plastics, the upper rim of the side and/or end walls of the packing containers has been provided with a plurality of shaped, upward projections, with corresponding recesses being provided at the bottom of the side and/or end walls. For stacking purposes, the projections on the rim of a lower packing container fit within and mate with the recesses at the bottom of the side and/or end walls of a packing container immediately above it and thus the stability of a stack of foam plastic packing containers has been improved, particularly during transportation over a bumpy road.

In the case of packing containers used for storage and transportation of perishables, the side and/or end walls and/or the floor of the packing container have sometimes been provided with a plurality of apertures to allow the introduction and circulation of cold air. This has the disadvantage that sometimes the introduction and circulation of cold air is blocked or otherwise interfered with by the contents of the packing container. Alternatively or additionally for the same purpose, the side and/or end walls have sometimes been provided with a plurality of discontinuities where sections of the side and/or end walls do not extend to the full height of other portions of the side and/or end walls.

In any event, those measures are useful only where the perishables are stored and transported under refrigerating conditions. In non-refrigerating conditions, the perishable contents soon reach ambient temperature, and this process is accelerated where there are a large number of apertures in the walls and/or in the floor or where there are large areas of discontinuities in the walls. Other disadvantages reside in the reduced strength of the packing containers and the increased likelihood of damage to the contents. With the costs of refrigeration now increasing, particularly in refrigerated vehicles, there is a need to devise a way of storing and transporting perishables which minimises the use of refrigeration of goods in transit.

In the past practice concerning the storage and transport of fruit and vegetables, the produce has been picked too early. Storage and transport of such produce under refrigerating conditions has often resulted in produce, at the time of consumption, having very little taste. There is an increasing public demand for more flavoursome fruit and vegetables. That demand may be met by sunripened produce but greater care is required for handling riper produce.

DESCRIPTION OF THE INVENTION

It is an object of the invention to provide means whereby a perishable product may be carded over long distances without the need for refrigeration in transit.

It is a further object of the invention to provide a packing container of the type generally described which has an improved capacity to keep perishables at low temperatures when stored or transported under non-refrigerating conditions.

It is also an object of the invention to provide a packing container, the use of which will result in more flavoursome produce reaching the market.

Basically, the invention involves the use of a closable packing container made from material having good heat insulating properties. The heat insulation properties of the material should be such that the interior of a packing container should remain at substantially the same temperature irrespective of whether the packing container is positioned in a hotter or colder environment. Suitable materials are expanded foam plastics. Polystyrene is a preferred material. It is a feature of the invention that the container is so equipped that it has two possible modes of use—a storage mode and a transit mode.

In the application of the invention to a rectangular packing container, the tray is provided with a lid. The floor, walls and lid are preferably of solid expanded foam material which is substantially impermeable to air so that when the lid is in its closed position the container encloses a space which is substantially uneffected by external influences so that there is a very low temperature loss between the interior of the container and the outside. In this situation, the container is in its transit mode of use.

When several containers are assembled in a vertical stack, it is optional whether lids are provided for other than the top container. In the transit mode, a substantially airtight closure for a lower tray may be provided by the floor of the tray immediately above it so that there is minimal heat leakage between the inside and outside of the packing container.

In its storage mode, the lid (or the floor of the tray immediately above it) is differently positioned to permit limited access to the interior of the tray. Containers in this mode may be stored in a refrigerating chamber in which refrigerating air is circulating. In this mode, the access to the interior of the containers is sufficient to allow the circulating refrigerating air to flow into the containers and flow around to cool the contents. With the contents appropriately chilled, the packing containers may be adjusted to the transit mode and transported over long distances with perishable contents kept at a safe temperature to avoid deterioration.

In accordance with the invention, there is provided a closable, stackable packing container for the storage of perishables and transport thereof without the need for refrigeration in transit, said container comprising a tray having a floor and an upstanding wall extending around the perimeter of the floor, a lid to tightly close the container, said container being made from solid material having good heat insulating properties, a plurality of shaped upward projections on the upper rim of the wall and correspondingly shaped and positioned recesses on the bottom edge of the wall and on the underside of the lid, characterised in that the projections are asymmetrically arranged so that the container may be used in a transit mode wherein the projections on the rim fit within and mate with the corresponding recesses in the underside of the lid so that the container is substantially airtight and there is minimal heat leakage between the interior and the exterior of the container, or the container may be used in a storage mode wherein the lid is repositioned with respect to the tray so that the projections on the rim no longer register with recesses on the lid which rests on top of the projections and is then spaced from the rim to allow limited access to the interior of the tray sufficient to allow circulating refrigerating air to flow into the tray and around the contents to cool them.

In a stack, only the top tray need be provided with a lid. In the transit mode, the projections on the rim of each of the other trays fit within and mate with the recesses in the bottom edges of the wall of the tray immediately above it. In the storage mode, the trays are repositioned so that each tray other than the bottom one rests on top of the projections on the rim of the tray immediately below it and is then spaced from the rim to allow limited access to the interior of the tray to allow circulating refrigerating air to flow into the tray and around the contents to cool them.

When the packing containers are in the storage mode, the contents may be appropriately chilled. The packing containers may be adjusted to the transit mode and may be transported over long distances with perishable contents kept at a safe temperature to avoid deterioration.

According to a critical feature of the invention, the shaped projections are asymmetrically arranged. For example, the projections may be positioned asymmetrically along the rims of the walls, or the number of projections on the rim of one wall may be different from the number of projections on the rim of the opposite wall.

BRIEF DESCRIPTION OF THE DRAWINGS

The invention will be described in relation to a closable, stackable, rectangular packing container comprising a tray and a fitting lid, each formed in one piece from a material having good heat insulating properties such as synthetic foam polystyrene. The tray has a substantially rectangular floor and upstanding side and end walls extending substantially at right angles to the floor. In the drawings.

DESCRIPTION OF EMBODIMENTS

Figure 1:
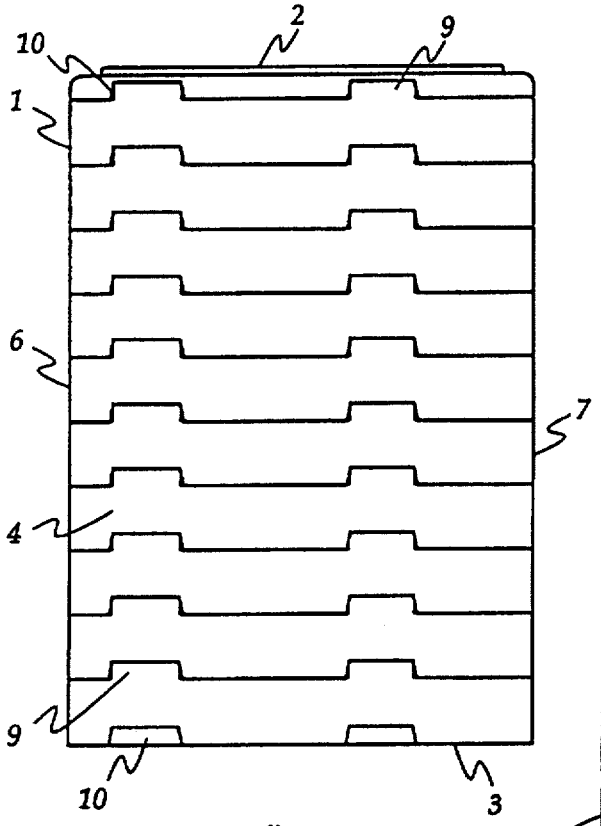
FIG. 1 is a side view of a stack of trays in the transit mode with a lid on the top tray.

As illustrated in the drawings, a closable packing container comprises a tray 1 and a fitting lid 2. Tray 1 comprises a substantially rectangular floor 3, upstanding substantially rectangular side walls 4 and 5 and upstanding substantially rectangular end walls 6 and 7. Tray 1 is formed on the upper rim of side walls 4 and 5 and end walls 6 and 7 with a plurality of shaped, upward projections 9 and is also formed with correspondingly shaped and positioned recesses 10 at the bottom edges of side walls 4 and 5 and end walls 6 and 7. The shaped projections 9, and recesses 10, are asymmetrically arranged. In the case of side walls 4 and 5, projections 9 are positioned asymmetrically along the rim of each side wall. In the case of end walls 6 and 7, only one projection is formed on the rim at the centre of end wall 7 and two spaced projections 9 are formed on the rim of end wall 6 towards the ends thereof. Similarly shaped and positioned recesses are formed in the underside of lid 2.

The number and positions of the projections may vary over a wide range. The size and shape of the projections are selected so that, in the transit mode, they form a firm fit in mating recesses in the lid or in the bottom of the immediately higher tray in a stack. Further, the projections should be provided with substantially flat horizontal upper surfaces so that, in the storage mode, they conveniently support the loaded trays above. Preferably, projections 9 are substantially rectangular parallelepiped in shape. The top flat surface of projections 9 may have a slight upward inclination towards the interior of the tray.

FIG. 1 illustrates a stack of packing containers in the transit mode. Projections 9 on the rim of a lower tray 1 fit within and mate with recesses 10 at the bottom edge of the side and end walls of the tray 1 immediately above it. The top tray 1 is closed with a fitted lid 2. Thus, in the transit mode, each packing container is firmly closed so that the interior of the packing containers is substantially immune to external influences. Further, a stable stack is provided.

Figure 2:
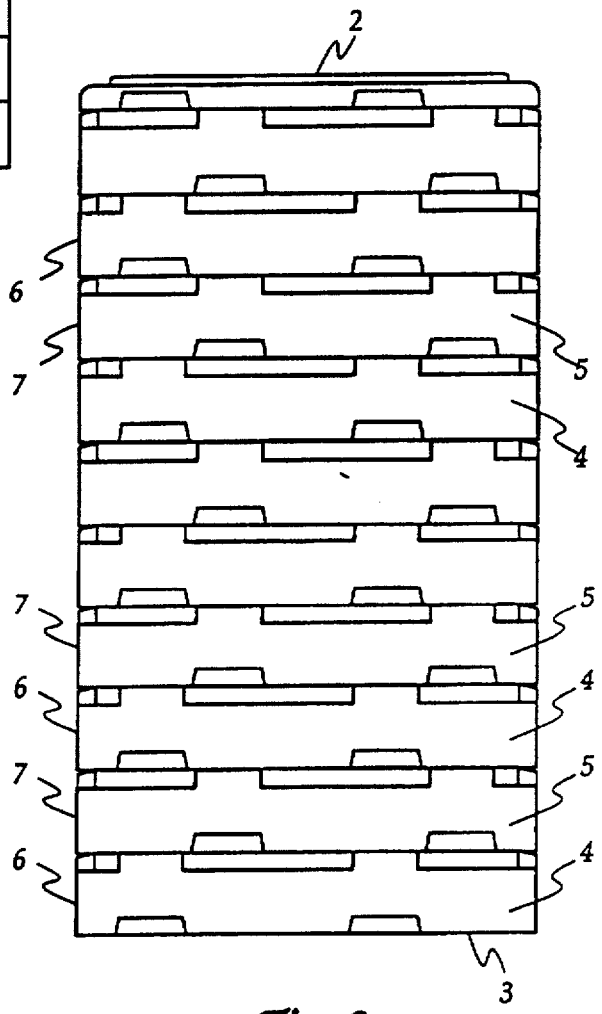
FIG. 2 is a side view of a stack of trays in the storage mode with a lid on the top tray.
Figure 3:
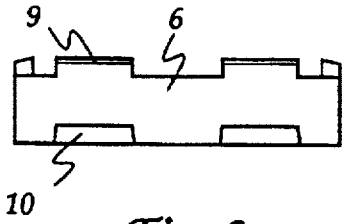
FIG. 3 is an external end view of a tray illustrating one end wall thereof.
Figure 4:
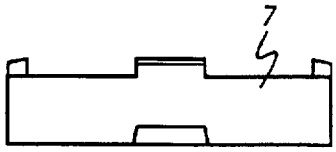
FIG. 4 is an external end view of a tray illustrating the opposite end wall.
Figure 5:
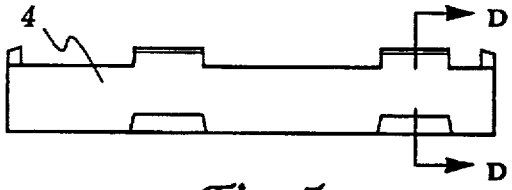
FIG. 5 is an external side view of a tray illustrating a side wall.
Figure 6:
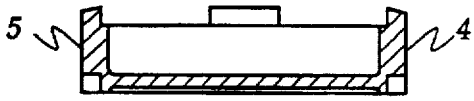
FIG. 6 is a sectional view of the tray along the line D—D of FIG. 5.
Figure 8:
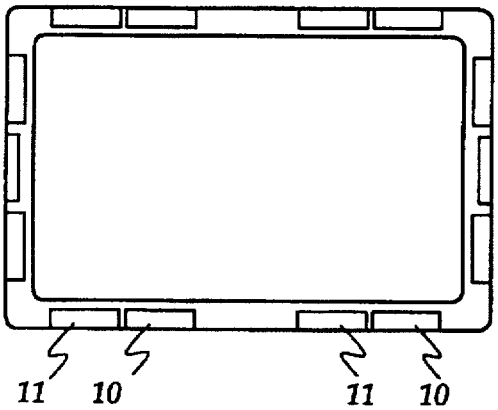
FIG. 8 is a plan view of the underside of the lid.
Figure 7:
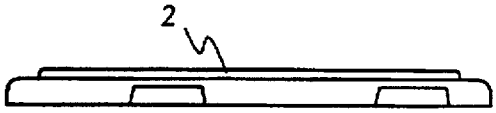
FIG. 7 is a side view of the lid.
Figure 10:
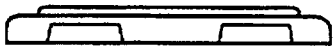
FIG. 10 is an end view of the lid.
Figure 9:
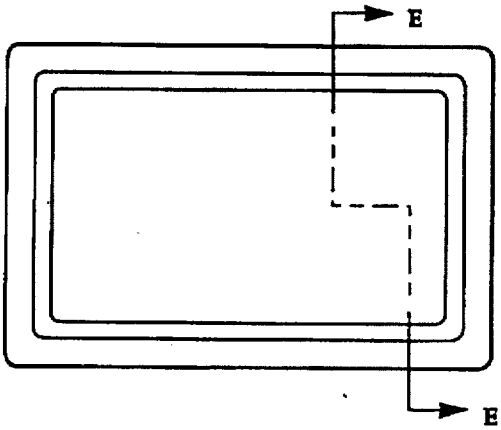
FIG. 9 is a plan view of the upper side of the lid.
Figure 11:
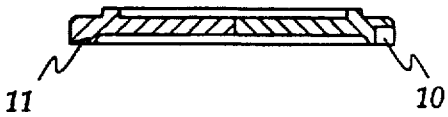
FIG. 11 is a sectional view of the lid along the lines E—E of FIG. 9.

In the storage mode illustrated in FIG. 2, every second tray 1 in a stack and lid 2 is turned 180 degrees around a vertical axis. Because trays 1 are rectangular in plan, no additional pallet space is required. Projections 9 are no longer in register with recesses 10. Rather, the underside of the floor of an upper tray rests on the top surface of projections 9 on the rim of the tray 1 immediately below it. Thus, there is a significant separation between stacked trays 1. When stored in a cool room, circulating refrigerating air flows into trays 1 to cool the contents. Further, the separation allows limited access to the interior of trays 1 for inspection of the contents and for treatment of the contents for fumigating or other purposes.

To improve stability of a stack when in a storage mode, additional and shallower recesses 11 may be formed on the bottom edge of the tray wall and on the underside of lid 2. Recesses 11 would be shaped to mate with projections 9 and positioned to allow engagement of projections 9 and recesses 11 in the storage mode. The relative depths of recesses 10 and 11 would be chosen to allow significant spacing of trays 1 in the storage mode.

Lids if used on ail trays in a stack, may be contoured to fit firmly around projections 9 on the upper rim of a tray. In this form, the projections are made of sufficient height to project above the upper surface of the lid. Alternatively, the lid may be thickened at its peripheral edge and formed with recesses on its underside to fit over and mate with the projections on the rim of the tray and also provided with projections on its upper side to fit in and mate with recesses on the floor of another tray above.

Preferably, the floor of a tray is raised above the level of the recesses in the bottom of the walls of the tray to provide strength and more room for the contents in the tray below. Further, the upper surface of a lid may be similarly raised for mating purposes.

To reduce costs of manufacture, the thickness of the walls, floor and lid should be kept to a minimum that would allow the packing container to meet the criteria referred to above. However, it is within the concept of the invention that, to provide greater protection, one end wall of the packing container is made thicker than the thickness of the other walls. When positioned on a pallet, the thick end wall may be placed on the outside of the pallet.

A vertically disposed finger groove may be provided on the internal surface of a wall to facilitate the extraction of the first punnet when the tray is filled with punnets of, say, strawberries. The internal surface of the walls may be provided with other vertical grooves for the mounting of divisional partitions. A soft shock absorber mat, preferably of plastic, may be used to support soft fruit. A plastic mat may be conveniently washed for repeated use. Delicate fruit could be housed in shaped punnets which keep each piece of fruit separate. The punnets should be sufficiently perforated to allow the circulation of air around the fruit. In some cases, air circulation is desirable between containers when stacked in transit mode. For this purpose, slots or the like may be formed in the floor of intermediate trays in the stack. Ambient air would still be excluded from the interior of the trays. The bottom edge of a packing container may be further recessed to form a convenient hand grip. Packing containers may be covered with an abrasion resistant material to extend the useful life of the container.

I claim:

1. A closable, stackable packing container for the storage of perishables and transport thereof without the need for refrigeration in transit, said container comprising a tray having a floor and an upstanding wall extending around the perimeter of the floor, a lid to tightly close the container, said container being made from solid material having good heat insulating properties, a plurality of shaped upward projections on the upper rim of the wall and correspondingly shaped and positioned recesses on the bottom edge of the wall and on the underside of the lid, characterised in that the projections are asymmetrically arranged so that the container may be used in a transit mode wherein the projections on the rim fit within and mate with the corresponding recesses in the underside of the lid so that the container is substantially airtight and there is minimal heat leakage between the interior and the exterior of the container, or the container may be used in a storage mode wherein the lid is repositioned with respect to the tray so that the projections on the rim no longer register with recesses on the lid which rests on top of the projections and is then spaced from the rim to allow limited access to the interior of the tray sufficient to allow circulating refrigerating air to flow into the tray and around the contents to cool them.

2. A packing container as claimed in claim 1, wherein said tray has a rectangular floor and upstanding side and end walls.

3. A packing container as claimed in claim 2, wherein the projections on the upper rim of the side walls are positioned asymmetrically along the rim of each side wall.

4. A packing container as claimed in claim 2, wherein one projection is formed on the rim at the centre of one end wall and two spaced projections are formed on the rim of the opposite end wall towards the ends thereof.

5. A packing container as claimed in claim 1, wherein each projection comprises a substantially flat horizontal upper surface.

6. A packing container as claimed in claim 1, wherein each projection comprises a substantially flat upper surface having a slight upward inclination towards the interior of the tray.

7. A packing container as claimed in claim 1, wherein the underside of the lid and the bottom edge of wall are provided with additional, but shallower, recesses to engage the projections when the container is in the storage mode.

8. A packing container as claimed in claim 1, wherein the floor is raised above the level of the recesses in the bottom edge of the wall.

9. A packing container as claimed in claim 1, wherein a soft shock absorbing mat is provided to support the contents of the container.

10. A packing container as claimed in claim 1, made from polystyrene foam material.

11. A stack of packing containers as claimed in claim 1, wherein only the top tray is provided with a lid, the arrangement being such that in the transit mode, the projections on the rim of each of the other trays fit within and mate with the recesses in the bottom edge of the wall of the tray immediately above it and, in the storage mode, the trays are repositioned so that each tray other than the bottom one rests on top of the projections on the rim of the tray immediately below it and is then spaced from that rim to allow limited access to the interior of the tray to allow circulating refrigerating air to flow into the trays and around the contents to cool them.

* * * * *